United States Patent [19]

Waters

[11] 4,272,902

[45] Jun. 16, 1981

[54] FIRE-ARMS

[75] Inventor: Frank E. Waters, Brentwood, England

[73] Assignee: Chartered Industries of Singapore Private Limited, Jalan Boon Lay, Singapore

[21] Appl. No.: 966,386

[22] Filed: Dec. 4, 1978

[30] Foreign Application Priority Data

Dec. 5, 1977 [GB] United Kingdom ..... 50593/77

[51] Int. Cl.[3] ..... F41C 15/12

[52] U.S. Cl. ..... 42/25

[58] Field of Search ..... 42/25

[56] References Cited

U.S. PATENT DOCUMENTS

| | | | |
|---|---|---|---|
| 2,591,733 | 4/1952 | Simpson | 42/25 |
| 2,710,477 | 6/1955 | Simpson | 42/25 |
| 3,538,635 | 11/1970 | Friend | 42/25 |

FOREIGN PATENT DOCUMENTS

| | | |
|---|---|---|
| 273302 | 10/1927 | United Kingdom . |
| 280136 | 11/1927 | United Kingdom . |
| 476916 | 12/1937 | United Kingdom . |
| 746489 | 3/1956 | United Kingdom . |
| 1056056 | 1/1967 | United Kingdom . |
| 1221013 | 2/1971 | United Kingdom . |

*Primary Examiner*—Charles T. Jordan

*Attorney, Agent, or Firm*—Ladas & Parry

[57] ABSTRACT

A fire-arm having a bolt assembly which includes a bolt received by a bolt carrier and axially movable relative thereto and a T-shaped ejector set freely in a T-shaped recess in the bolt and retained in the recess by the bolt carrier while being held axially relative to the bolt by the T-shape of the extractor and the recess. In a first position of the bolt relative to the carrier the extractor is held in a first position in which it engages a cartridge for extraction from the chamber and in a second position of the bolt relative to the carrier the extractor is movable to a second position from which it can move to engage a cartridge.

10 Claims, 11 Drawing Figures

FIRE-ARMS

This invention is concerned with improvements relating to fire-arms, and more particularly with a bolt assembly incorporating an extractor mechanism.

When a cartridge is fired in a weapon, the cartridge case remaining in the chamber after firing must be removed before a further round can be inserted into the chamber. The removal of the cartridge case from the chamber can be effected by means of an extractor mounted on the bolt of the weapon, the extractor being arranged to engage a flange at the rear of the cartridge case and pull the case from the chamber as the bolt is moved away from the chamber face in preparation for firing the next round.

According to the present invention there is provided a bolt assembly for a fire-arm, the assembly comprising a bolt carrier, a bolt received in and movable relative to the bolt carrier, a recess in the bolt and an extractor having a body freely set in and removable from the recess in the bolt, the extractor and recess being shaped to hold the extractor relative to the bolt for movement with the bolt relative to the bolt carrier and the extractor having a head for engaging a cartridge case, the bolt being movable relative to the bolt carrier between a first position, in which the extractor is held in a first position in which the extractor head will in use be engaged with a cartridge case to withdraw the case from the chamber of the fire-arm, and a second position, in which the extractor is movable to a second position in which the extractor head is in a position from which it can engage with a cartridge.

The extractor is not pivotally connected to the bolt, thereby obviating the necessity of a pivot pin for the extractor, as in generally provided. The provision of such a pivot pin necessitates providing bores in the bolt and the extractor. Not only is the drilling of such bores difficult, but the existance of the bores materially reduces the strength of the extractor and, to a lesser extent, the bolt.

The extractor may be received in a recess defined both between the bolt and bolt carrier, but is preferably in a recess defined in the bolt, and the bolt carrier receives the bolt in a bore having a frusto-conical portion which widens forwardly thereof and into which a part of the extractor is movable in the second position of the bolt.

Advantageously, the rearward end portion of the extractor, the end portion remote from the chamber, includes a frusto-conical surface portion, the apex of the cone of which is directed rearwardly of the bolt carrier, the frusto-conical portion of the extractor being in register with the frusto-conical portion of the bore in the bolt carrier in the second position of the bolt, the extractor then pivoting about its rearward end between its first and second positions.

The frusto-conical portion of the bore in the bolt carrier may be provided by a recess in the bore, the wall of the bore at the forward end of the recess bearing on the frusto-conical portion of the extractor in the first position of the bolt.

A spring may be provided to bias the extractor to its second position.

Advantageously, the extractor is generally T-shaped, the head of the extractor being provided at the end of the leg of the T, and a generally T-shaped recess is provided in the bolt to receive the extractor and hold the extractor relative to the bolt for movement with the bolt relative to the bolt carrier. The bolt is preferably generally cylindrical with diametrically opposed recesses, in one of which the extractor is received and in the other of which a cartridge case ejector plunger is received.

The invention will be more fully understood from the following description of an embodiment thereof, given by way of example only, with reference to the accompanying drawings.

Figure 1:
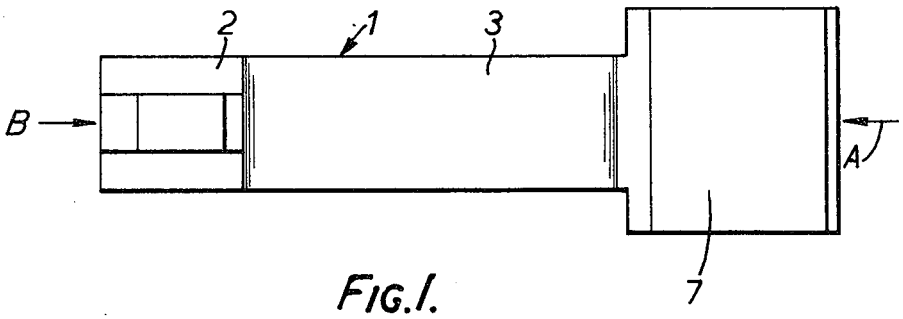
FIG. 1 is a top plan view of an extractor for an embodiment of a bolt assembly according to the present invention.
Figure 2:
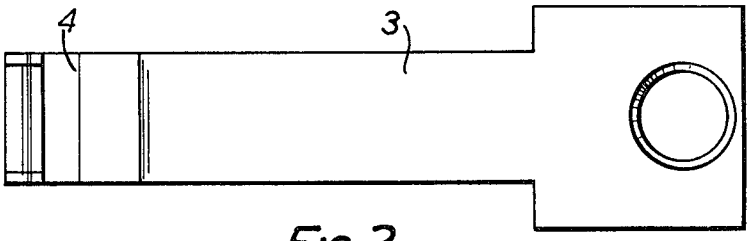
FIG. 2 is a bottom plan view of the extractor of FIG. 1.
Figure 5:
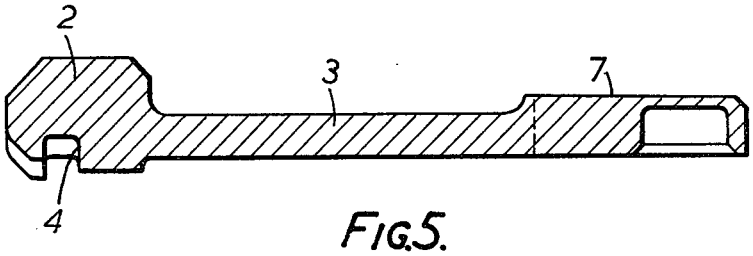
FIG. 5 is a section along the line V—V of FIG. 3.
Figure 3:
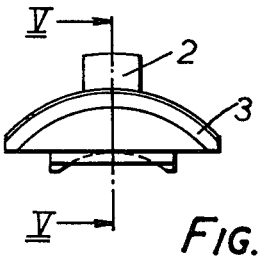
FIG. 3 is an end view in the direction of the arrow A of the extractor of FIG. 1.
Figure 4:
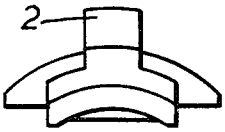
FIG. 4 is an end view in the direction of the arrow B of the extractor of FIG. 1.

The extractor 1, shown in FIGS. 1 to 5 comprises a generally T-shaped body 3 which in cross section has the shape of a sector of a circle. The body 3 includes an extractor head 2 at the end of the leg of the T. The head 2 is provided with an arcuate groove 4 adapted to receive a portion of a flange 5 (FIG. 6) formed in the rear end of a cartridge case 6.

Figure 9:
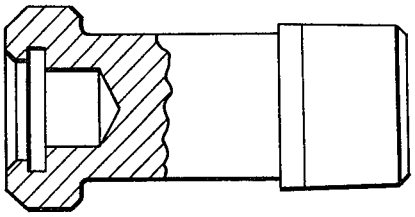
FIG. 9 shows a blank for use in the manufacture of the extractor of FIGS. 1 to 5.

The extractor can conveniently be made by machining a blank as shown in FIG. 9 and cutting two extractors from the blank. The blank is circular in transverse cross section throughout its length and the right-hand end portion (as viewed in FIG. 9) is frusto-conical, the cone widening towards the left-hand or forward end. The frusto-conical portion may for example have an included angle of 2°. The result of the frusto-conical machining of the blank is that the portion 7 of the finished extractor forming the cross-bar of the generally T-shaped body 3 has an outer surface which is part frusto-conical, the cone widening towards the head of the body 3. The extractor may be formed of any suitable metal, for example steel BS970 En39B.

Figure 6:
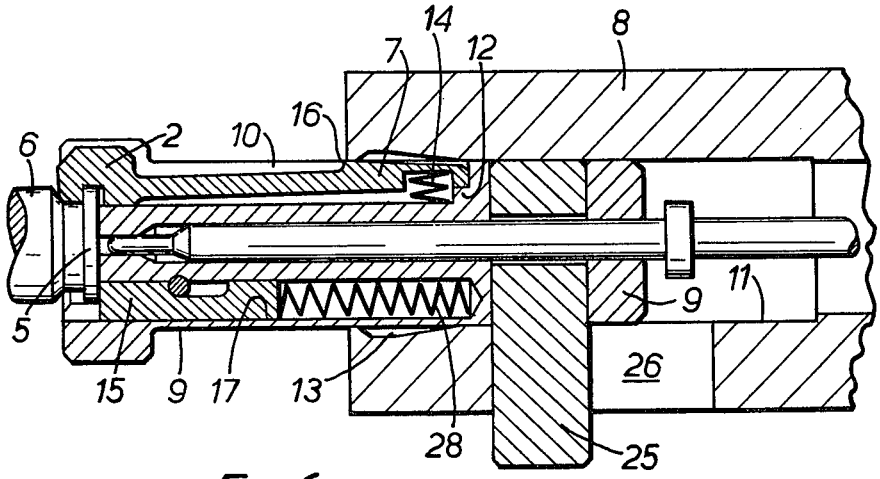
FIGS. 6 and 7 are longitudinal sectional views of the embodiment of a bolt assembly incorporating the extractor of FIGS. 1 to 5.
Figure 7:
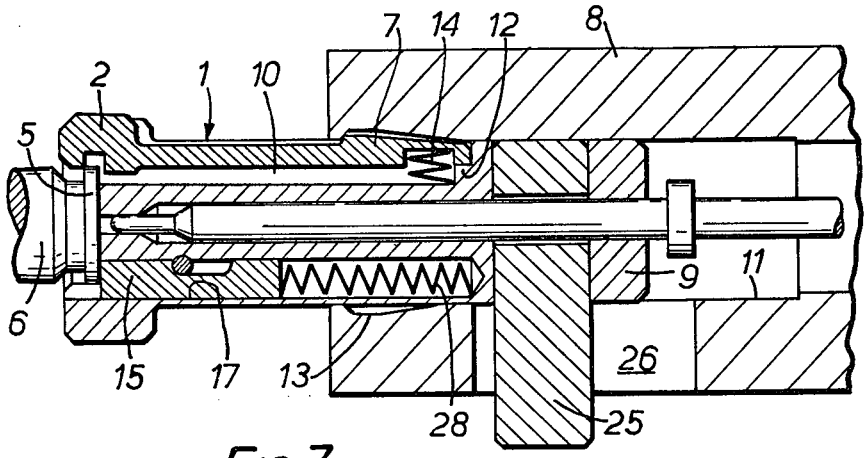
Figure 8:
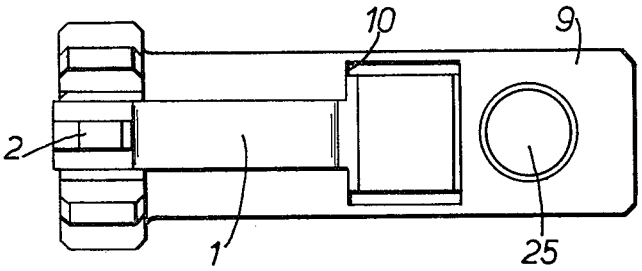
FIG. 8 is a plan view of the bolt assembly of FIGS. 6 and 7.

FIGS. 6 to 8 illustrate the extractor of FIGS. 1 to 5 mounted in a bolt assembly of a weapon. The bolt assembly includes a bolt carrier 8 and a bolt 9 slidably mounted in a cylindrical axial bore 11 in the bolt carrier. A recess is provided in the bolt 9 for the extractor. As shown the bolt 9 is generally cylindrical and has a generally T-shaped groove 10 machined in its surface to freely receive the T-shaped body of the extractor. When the extractor is set in the T-shaped groove of the bolt, and the bolt is received in the bore of the bolt carrier, the extractor is held captive in the bolt only by the bolt carrier and cannot be removed until the bolt is moved out of the bolt carrier sufficient to permit the extractor to be lifted out of the T-shaped groove 10. The extractor is however retained by the T-shape of the extractor and recess in the bolt for relative axial movement of the bolt carrier and the bolt.

A step 12 is provided at the rear end of the T-shaped groove 10 to provide an abutment for the rear edge of the extractor, as shown in FIGS. 6 and 7.

The bore 11 in the bolt carrier is cylindrical throughout a substantial portion of its length, but has an annular recess or groove 13 formed adjacent the forward end of the bolt carrier. The axially extending wall of the recess 13 is substantially frusto-conical and complementary to the frusto-conical portion 7 of the extractor body. The cone of recess 13 has a larger included angle than that of portion 7 of the extractor body and widens forwardly of the bore so that, when the portion 7 of the extractor body and the recess are in register, the portion 7 of the extractor body can move into the recess 13, the body effectively pivoting about the step 12. The head 2 of the extractor is thus moved radially outwardly relative to the axis of the bolt.

A small compression spring 14 is advantageously located between the bolt and the portion of the extractor body adjacent the inner end of the body remote from the head 2. It has been found that the provision of such a spring, while not essential, is advantageous to stabilise the extractor so producing a more reliable ejection of spent cartridges by ejector plunger 15 which is received in an axial bore 17 diametrically opposite the groove 10 in the bolt.

In order to illustrate the function of the extractor reference will now be made to FIGS. 10 and 11. Here is seen bolt 9 in bolt carrier 8 which is slidable on guide rods 20 set in a receiver 21 at the forward part of which is chamber 22. The bolt has locking teeth 23 which in a first angular position of the bolt about its axis can pass between corresponding teeth formed in lip 24 of the chamber 22 and in a second angular position can move into register with the teeth formed in lip 24, this angular positioning being determined by a cam pin 25 on bolt 9 which rides in cam slot 26 in bolt carrier 8. The bolt is furthermore positioned angularly by a plate 27 in the receiver. In the position shown in FIG. 10 the cam pin is held in a horizontal attitude by the plate 27.

Figure 11:
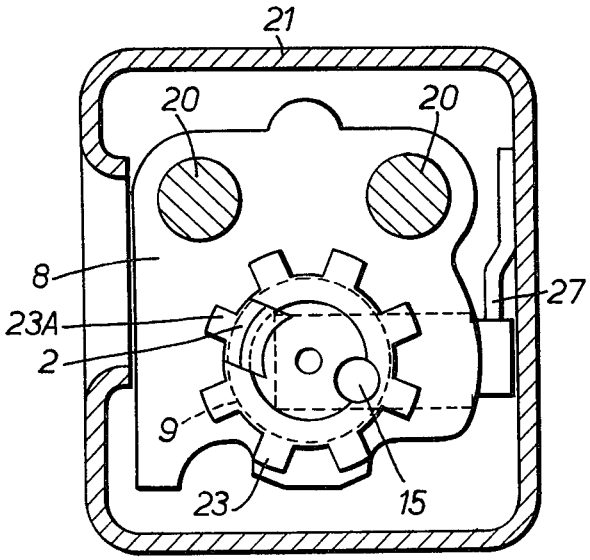
FIG. 11 is a section on the line XI—XI of FIG. 10.

In FIG. 11 it can be seen that the extractor head 2 includes a tooth—like projection 23A which serves to strengthen the head.

Figure 10:
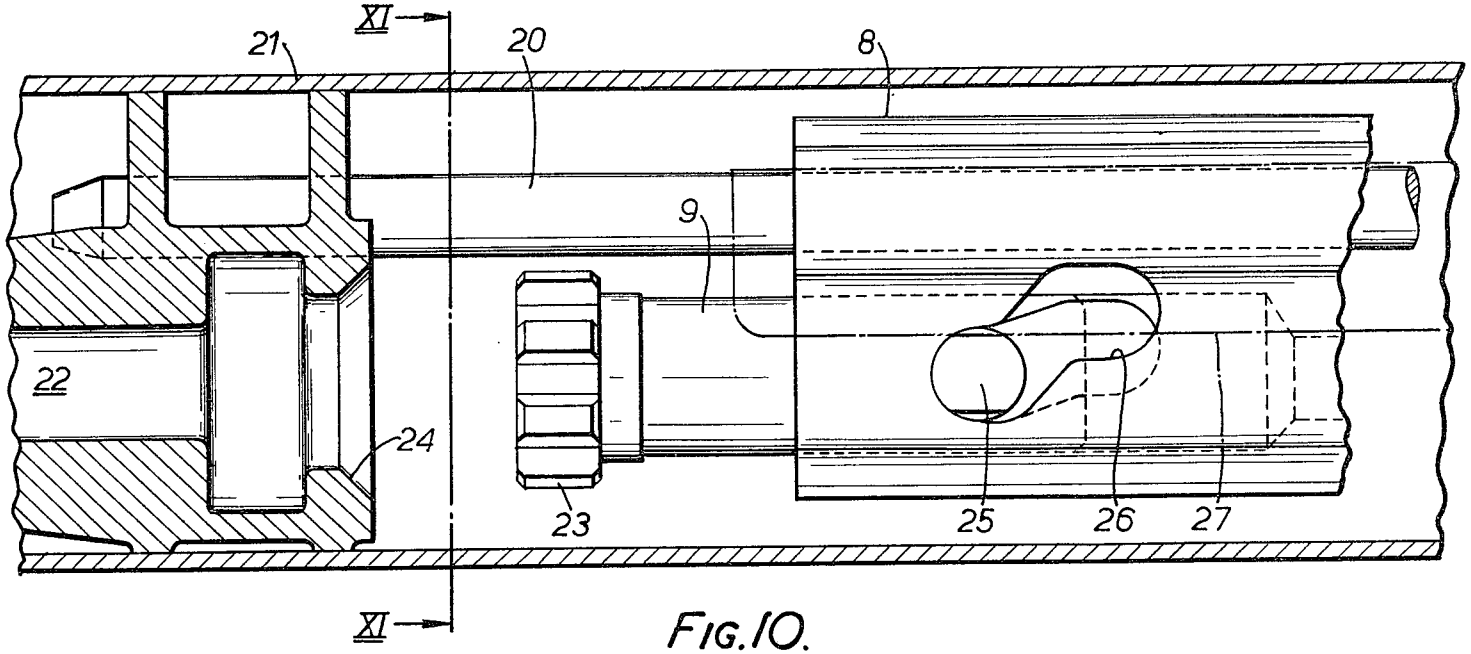
FIG. 10 is a side elevation of the bolt and bolt carrier in a receiver and spaced from a barrel, the latter two being shown in section.

When a round is to be fed into the chamber, the extractor is as shown in FIGS. 7 and 10 with the bolt projecting forward of the carrier, the cam pin 25 riding along the under edge of plate 27 and held by the cam slot from movement rearward relative to the bolt carrier. The extractor is biased outwardly to its outer or second position so that the head is clear of a round which is pressed forward by the assembly toward the chamber. During feed of the cartridge into the chamber the plunger 15 is depressed rearwardly thereby compressing ejecting spring 28. As cam pin 25 passes forwardly of plate 27, teeth 23 have passed lip 24 and, the bolt being arrested, the carrier continues forwardly thereby, through slot 26, turning the bolt to lock it to the chamber. This relative movement of the carrier and bolt brings frusto-conical portion 7 rearward of recess 13 and moves the head from its position clear of the flange to lock the extractor head 2 behind, that is forward of, the cartridge flange 5. Upon firing the cartridge, a gas operated plunger (not shown) drives the bolt carrier rearwardly. Momentarily the head 2 will disengage from the cartridge flange as the recess 13 passes over the portion 7 but this occurs before the bolt starts its return travel and before that return travel starts the extractor head 2 is relocked on to the cartridge flange 5 by portion 16 of the bolt carrier. When the forward end of the carrier cam slot 26 reaches cam pin 25, the bolt, now unlocked from the lip, is drawn back bringing the cartridge from the chamber. When free of the chamber the cartridge is pivoted out of engagement with extractor head 2 by the ejector plunger.

The cycle restarts as the carrier is driven forward with bolt 9 in the position shown in FIG. 7.

I claim:

1. A bolt assembly for a fire-arm, the assembly comprising a reciprocable bolt carrier, a bolt reciprocably received in and rotatable relative to the bolt carrier, a recess in the bolt and an extractor having a body which in unassembled condition of the bolt and bolt carrier is freely placeable in and removable from the recess in the bolt, and which is pivotally retained in the recess in the assembled condition of the bolt assembly by the bolt carrier, the extractor and recess being shaped to hold the extractor relative to the bolt for reciprocation and rotation of the bolt relative to the bolt carrier and the extractor having a head for engaging a cartridge case in a first position of relative reciprocation of the bolt and bolt carrier, the extractor being held by the bolt carrier in a first pivotal position in which the extractor head will in use be engaged with a cartridge case to withdraw the case from the chamber of the fire-arm while in a second position of relative reciprocation of the bolt and the bolt carrier the extractor being pivotable to a second position from which the head can move to engage with a cartridge.

2. A bolt assembly as claimed in claim 1, wherein the bolt is received in a bore in the bolt carrier.

3. A bolt assembly according to claim 1 in which the bolt carries a cam follower and the bolt carrier includes a track in which the follower is received, means on a bolt carrier receiver maintaining the bolt in said second position of relative reciprocation during forward motion of the carrier with the bolt projecting forwardly of the bolt carrier until the completion of forward movement of the bolt closes the chamber, the means on the receiver at that position of the bolt upon the forward motion of the bolt carrier allowing the bolt through said track and follower to rotate and lock relative to the chamber.

4. A bolt assembly as claimed in claim 1, in which the rearward end of the bolt recess includes a step engaged by the rearward end of the extractor to serve as a pivot when the extractor pivots between its two positions.

5. A bolt assembly as claimed in claim 2, wherein said bore in said bolt carrier includes a frusto-conical portion widening forwardly toward the chamber and said extractor body includes a part received by said frusto-conical portion in said second position of relative reciprocation of said bolt.

6. A bolt assembly as claimed in claim 5, wherein the rearward end portion of said extractor body includes a part frusto-conical surface portion which widens forwardly toward the chamber, said frusto-conical portion of the extractor being in register with said frusto-conical portion of said bore in said bolt carrier in said second position of said bolt.

7. A bolt assembly as claimed in claim 6 wherein said frusto-conical portion of said bore in said bolt carrier is provided by a recess in the wall of said bore; said wall of said bore at the forward end of said recess bearing on said frusto-conical portion of said extractor in said first position of relative reciprocation of said bolt.

8. A bolt assembly as claimed in claim 1, including a spring biasing said extractor to its second position.

9. A bolt assembly as claimed in claim 1, wherein said extractor is generally T-shaped, said head being provided at the end of the leg of said T, and said body in cross-section having the shape of a sector of a cylinder.

10. A bolt assembly as claimed in claim 9, wherein said bolt is generally cylindrical, is provided with a generally T-shaped groove for receiving said extractor, and a diametrically opposite recess for a cartridge ejector.

* * * * *